United States Patent [19]

Sanada et al.

[11] 4,108,126

[45] Aug. 22, 1978

[54] FUEL FEED DEVICE OF AN INTERNAL COMBUSTION ENGINE

[75] Inventors: Masakatsu Sanada, Toyota; Masahiko Nakada, Okazaki, both of Japan

[73] Assignee: Toyota Jidosha Kogyo Kabushiki Kaisha, Toyota, Japan

[21] Appl. No.: 793,637

[22] Filed: May 4, 1977

[30] Foreign Application Priority Data

Mar. 15, 1977 [JP] Japan ..... 52-27559

[51] Int. Cl.[2] ..... F02M 31/00

[52] U.S. Cl. ..... 123/122 E; 123/133; 261/160

[58] Field of Search ..... 123/122 E, 133, 136, 123/122 R; 261/160

[56] References Cited

U.S. PATENT DOCUMENTS

| | | | |
|---|---|---|---|
| 1,953,809 | 4/1934 | Kenneweg | 261/160 |
| 2,393,125 | 1/1946 | Clair | 261/160 |
| 3,593,694 | 7/1971 | Hilborn | 261/160 |

*Primary Examiner*—Ronald H. Lazarus

*Attorney, Agent, or Firm*—Stevens, Davis, Miller & Mosher

[57] ABSTRACT

Disclosed is a fuel feed device of an internal combustion engine. The fuel supply conduit communicating the carburetor and the fuel tank is arranged in the carburetor for cooling the carburetor and for vaporizing the low boiling components in the fuel only when the temperature of the engine is higher than a predetermined level. The fuel flowing out from the fuel supply passage located in the carburetor is introduced into a low boiling component separator. In this separator, the low boiling components in the fuel are removed, and then the fuel consisting of the high boiling components is fed into the carburetor to prevent the occurrence of an abnormal fuel metering operation under a high-temperature condition.

9 Claims, 1 Drawing Figure

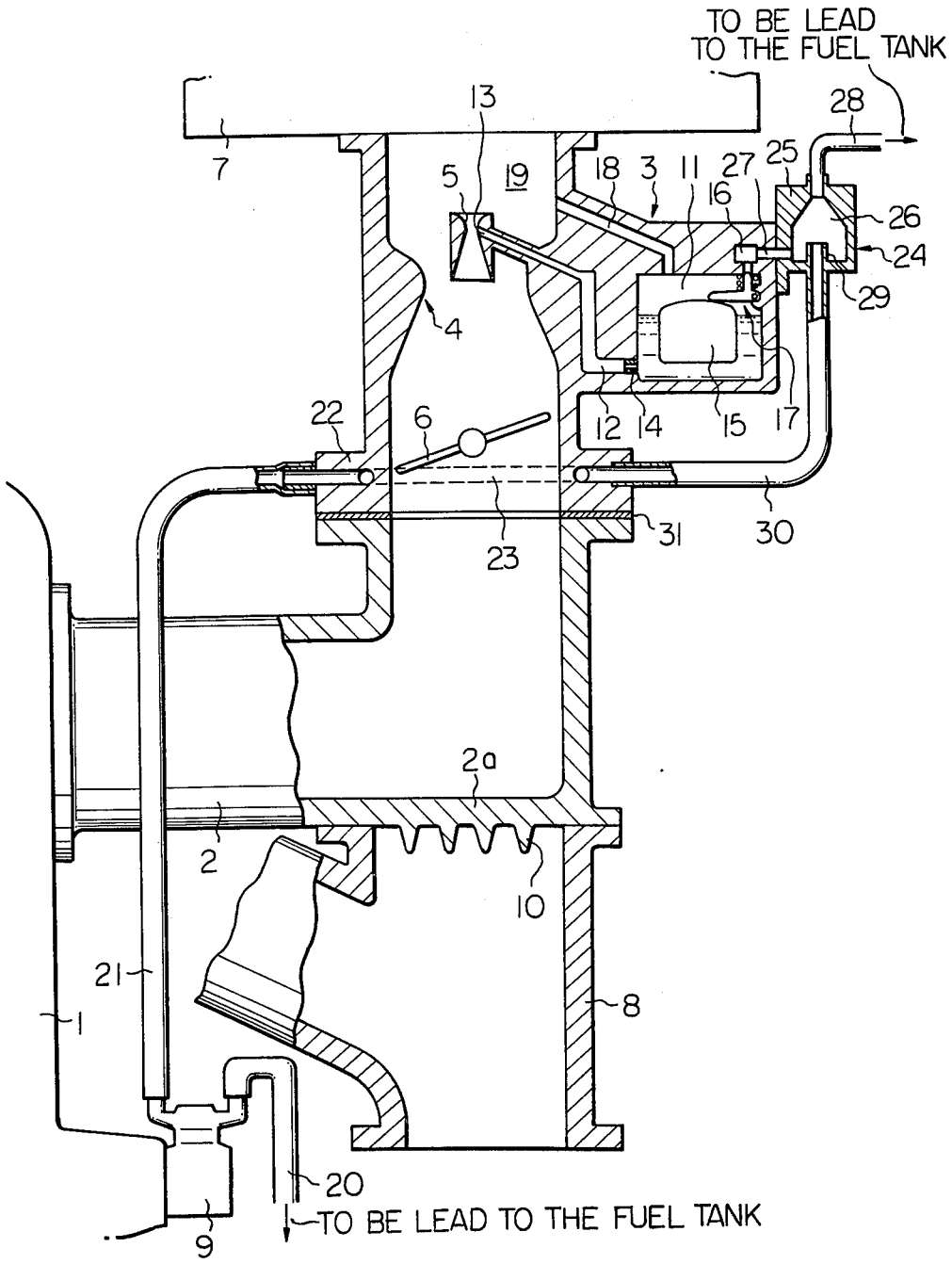
TO BE LEAD
TO THE FUEL TANK
13
28
7
5
19
18
3
11
27
25
16
26
24
29
4
22
6
12
14
15
17
31
30
23
2a
2
10
21
1
8
20
9
TO BE LEAD TO THE FUEL TANK

FUEL FEED DEVICE OF AN INTERNAL COMBUSTION ENGINE

DESCRIPTION OF THE INVENTION

The present invention relates to a fuel feed device of an internal combustion engine.

In general, when the temperature of an engine is increased to a great extent, the low boiling components in the fuel contained in a carburetor or in a fuel supply conduit interconnecting a carburetor with a fuel tank are vaporized. As a result of this, the fuel vapor is discharged from the float chamber of the carburetor into the introduced air flowing in the intake passage via the air vent of the carburetor.

In addition, the fuel in the fuel passage formed in the carburetor is pushed upwards by the bubbles of the fuel vapor whereby an excessive amount of fuel is injected into the intake passage from the main nozzle of the carburetor. When the temperature of an engine is high, if the fuel vapor is fed into the introduced air from the float chamber via the air vent or if an excessive amount of fuel is fed into the intake passage from the main nozzle as mentioned above, the air-fuel mixture fed into the cylinder of the engine becomes excessively rich. As a result, problems are caused wherein a desired operating condition of the engine cannot be obtained, and wherein a large amount of unburned components HC and CO is discharged into the exhaust system of the engine.

These problems can be solved by maintaining the temperature of the carburetor at a temperature which is lower than the boiling point of the low boiling components. However, this is very difficult in practical application. It is very difficult to maintain the temperature of the carburetor at a relatively low temperature, particularly in an engine adopting an exhaust gas heating system in which the intake manifold is heated by the exhaust gas for promoting the vaporization of fuel in the intake manifold, whereby the warm-up of the engine is improved. Consequently, in a conventional engine and particularly in an engine adopting such an exhaust gas heating system, if the engine is constructed for improving the warm-up of the engine, there occurs a problem in that, when the temperature of the engine is high, the temperature of the carburetor is increased to such a great extent that the air-fuel mixture fed into the cylinder of the engine becomes excessively rich.

An object of the present invention is to provide a fuel feed device capable of always forming an air-fuel mixture of an optimum air-fuel ratio in the intake passage of the engine.

According to the present invention, there is provided a fuel feed device of an internal combustion engine, comprising, a carburetor having a float chamber therein, a fuel reservoir, a fuel supply passage communicating the float chamber with the fuel reservoir and having a passage portion arranged to cool the carburetor and to vaporize the whereby the low boiling components in the fuel by the heat of the carburetor, and a separating means disposed in the fuel supply passage between the passage portion and the float chamber for respectively separating low boiling components and high boiling components from the fuel and for removing the low boiling components from the fuel fed into the float chamber.

The present invention may be more fully understood from the following description of a preferred embodiment of the invention, together with the accompanying drawing.

BRIEF DESCRIPTION OF THE DRAWING

The FIGURE is a schematic side view, partly in cross section, of a fuel feed device according to the present invention.

DESCRIPTION OF A PREFERRED EMBODIMENT

Referring to the FIGURE, 1 designates an engine body, 2 an intake manifold, 3 a carburetor, 4 a large venturi of the carburetor 3, 5 a small venturi, 6 a throttle valve, 7 an air cleaner, 8 an exhaust manifold, and 9 a fuel pump driven by the engine. A number of fins 10 are formed on the lower surface of the riser portion 2*a* of the intake manifold 2. As a result, the riser portion 2*a* is effectively heated by the exhaust gas flowing in the exhaust manifold 8. The carburetor 3 has in its housing a float chamber 11 and a fuel passage 12. This fuel passage 12 is connected to a main nozzle 13 opening into the small venturi 5 on one hand, and to the float chamber 11 via a fuel metering jet 14 on the other hand. In addition, disposed in the housing of the carburetor 3 is a needle valve mechanism 17 connected to the float member 15 for controlling an amount of the fuel fed into the float chamber 11 from a fuel supply passage 16. The inside of the float chamber 11 is connected to an intake passage 19 via an air vent 18. Thus, the pressure in the float chamber 11 is always maintained at an atmospheric pressure.

Fuel is fed into the carburetor 3 from a fuel tank (not shown) via fuel supply conduits 20 and 21 by the fuel pump 9. As is shown in FIGURE, formed in a mounting flange 22 of the carburetor 3 is a fuel passage 23 passing through the mounting flange 22 along the periphery of the flange 22. The fuel supply conduit 21 is connected to the inlet side of the fuel passage 23. In addition, the carburetor 3 is provided with a low boiling component separator 24. This low boiling component separator 24 has in its housing 25 a separating chamber 26. The lower half of the separating chamber 26 is formed in a cylindrical shape, while the upper half of the separating chamber 26 is formed in a concial shape. The lower end of the separating chamber 26 is connected to the fuel supply passage 16 via a fuel passage 27, while the upper end of the separating chamber 26 is connected to the fuel tank via a conduit 28. A fuel injection pipe 29 is arranged in the separating chamber 26 so as to project into the separating chamber 26 from the bottom thereof. This fuel injection pipe 29 is connected to the outlet side of the fuel passage 23 via a conduit 30.

In operation, when the temperature of the engine is relatively low, which in turn causes the temperature of the carburetor 3 to also be relatively low, since the fuel passing through the fuel passage 23 is not vaporized, liquid fuel containing no fuel vapor therein is introduced into the separating chamber 26. Then, a large part of the fuel introduced into the separating chamber 26 is fed into the float chamber 11 via the fuel passage 27, the fuel supply passage 26 and the needle valve mechanism 17. On the other hand, the remaining fuel is returned to the fuel tank via the conduit 28.

Contrary to this, when the temperature of the engine is relatively high thus causing the temperature of the carburetor 3 to also be relatively high, the low boiling components in the fuel introduced into the fuel passage 23 from the fuel pump 9 are vaporized in the fuel passage 23, whereby bubbles of the fuel vapor are created in the fuel passage 23. Since the temperature of the fuel introduced into the fuel passage 23 is relatively low and the fuel is vaporized the carburetor 3 is cooled by the low-temperature fuel and the latent heat.

The bubbles of the fuel vapor thus created are introduced into the separating chamber 26 via the conduit 30 together with the liquid fuel consisting of high boiling components. In the separating chamber 26, the bubbles of the low boiling components move upwards in the liquid fuel consisting of high boiling components and are returned to the fuel tank via the conduit 28. On the other hand, the liquid fuel consisting of high boiling components is collected at a position near the bottom of the separating chamber 26. Thus, this liquid fuel is fed into the float chamber 11 via the fuel passage 27 and the needle valve mechanism 17. Since the liquid fuel introduced into the float chamber 11 consists of high boiling components, the liquid fuel is no longer vaporized. Consequently, there is no danger that the fuel vapor will be introduced into the intake passage 19 via the air vent 18 and that the fuel in the fuel passage 12 will be forced out from the main nozzle 13 by the bubbles of the low boiling components.

In the present invention, the vaporization of the fuel in the carburetor 3 is decreased by the cooling operation caused by latent heat and also caused by the low-temperature fuel introduced into the fuel passage 23. In addition, the carburetor 3 according to the present invention has an automatic self-controlling function in which the fuel having a boiling point which is lower than the temperature of the carburetor 3 is vaporized and removed. Thereafter, only the fuel having a boiling point which is higher than the temperature of the carburetor 3 is fed into the float chamber 11.

The fuel passage 23 may be formed in a gasket 31 interposed between the intake manifold 2 and the mounting flange 22. In addition, the fuel passage 23 may be formed in a pipe arranged on and along the inner wall of the intake passage 19. Furthermore, the low boiling component separator 24 may be formed in one piece in the housing of the carburetor 3.

According to the present invention, since the air-fuel mixture fed into the cylinder of the engine does not become excessively rich when the temperature of the engine is high, a desired operating condition of the engine can always be obtained 1 and an amount of unburned HC and CO components in the exhaust gas can also be reduced. In addition, even if the engine is so constructed that the intake manifold is heated by the exhaust gas, the air-fuel mixture fed into the cylinder of the engine will not become excessively rich when the temperature of the engine is high. Consequently, in an engine adopting an exhaust gas heating system, a desired operating condition of the engine can be obtained while improving the warm-up operation of the engine.

While the invention has been described by referring to a specific embodiment chosen for purposes of illustration, it should be apparent that numerous modifications could be made thereto by those skilled in the art without departing from the spirit and scope of the invention.

What is claimed is:

1. A fuel feed device of an internal combustion engine, comprising:
   a carburetor having a float chamber therein;
   a fuel reservoir; a fuel supply passage communicating said float chamber with said fuel reservoir and having a passage portion arranged to cool said carburetor and to vaporize the low boiling components in the fuel by the heat of said carburetor, and;
   a separating means disposed in said fuel supply passage between said passage portion and said float chamber for respectively separating low boiling components and high boiling from the fuel and for removing said low boiling components from the fuel fed into said float chamber.

2. A fuel feed device as claimed in claim 1, wherein said carburetor comprises a housing and an intake passage formed in said housing, said passage portion of said fuel supply passage being arranged in said carburetor.

3. A fuel feed device as claimed in claim 2, wherein said passage portion is formed in said housing of said carburetor.

4. A fuel feed device as claimed in claim 3, wherein said housing of said carburetor has on its lower end a mounting flange, said passage portion being formed in said mounting flange.

5. A fuel feed device as claimed in claim 2, wherein said passage portion of said fuel supply passage is formed in a pipe arranged in said intake passage of said carburetor.

6. A fuel feed device as claimed in claim 1, wherein said engine comprises an intake manifold and a gasket interposed between said intake manifold and said carburetor, said passage portion being formed in said gasket.

7. A fuel feed device as claimed in claim 1, wherein said separating means comprises a housing, a cavity formed in said housing, an inlet arranged in the lower portion of said cavity and connected to said reservoir via said fuel supply passage, an outlet arranged in the lower portion of said cavity and connected to said float chamber, and a discharge port arranged in the upper portion of said cavity.

8. A fuel feed device as claimed in claim 7, wherein said cavity has on its lower end a bottom, said outlet being arranged in the vicinity of said bottom, said inlet being formed on an upper end of a pipe projecting upwards into said cavity from said bottom.

9. A fuel feed device as claimed in claim 7, wherein the upper half of said cavity is formed in a conical shape, the lower half of said cavity being formed in a cylindrical shape.

* * * * *